US011396087B2

(12) United States Patent
Chang

(10) Patent No.: US 11,396,087 B2
(45) Date of Patent: Jul. 26, 2022

(54) EASILY ASSEMBLED RATCHET WRENCH

(71) Applicant: Chih-Min Chang, Changhua County (TW)

(72) Inventor: Chih-Min Chang, Changhua County (TW)

( * ) Notice: Subject to any disclaimer, the term of this patent is extended or adjusted under 35 U.S.C. 154(b) by 119 days.

(21) Appl. No.: 16/711,895

(22) Filed: Dec. 12, 2019

(65) Prior Publication Data

US 2021/0008694 A1 Jan. 14, 2021

(30) Foreign Application Priority Data

Jul. 8, 2019 (TW) ..... 108123988

(51) Int. Cl.
*B25B 13/46* (2006.01)

(52) U.S. Cl.
CPC ..... *B25B 13/46* (2013.01); *B25B 13/463* (2013.01)

(58) Field of Classification Search
CPC ..... B25B 13/46; B25B 13/463; B25B 23/007
USPC ..... 81/60, 61–63, 65, 63.2, 63.1
See application file for complete search history.

(56) References Cited

U.S. PATENT DOCUMENTS 4,991,468 A * 2/1991 Lee ..... B25B 13/461 81/185
6,282,993 B1 * 9/2001 Forman ..... B25B 13/463 81/63
6,357,323 B2 * 3/2002 Chi ..... B25B 13/463 81/60
6,862,955 B1 * 3/2005 Shu-Sui ..... B25B 13/463 192/41 R
7,263,918 B1 * 9/2007 Chen ..... B25B 13/463 192/43.2
9,016,174 B2 * 4/2015 Lee ..... B25B 13/461 81/60
9,140,317 B2 * 9/2015 Buchanan ..... B25B 13/04
9,522,460 B2 * 12/2016 Wang ..... B25B 13/463
2005/0120834 A1 * 6/2005 Chang ..... B25B 13/463 81/60
2005/0241443 A1 * 11/2005 Chen ..... B25B 23/0035 81/60

(Continued)

FOREIGN PATENT DOCUMENTS

GB 2156935 A * 10/1985 ..... F16D 1/00

*Primary Examiner* — Joseph J Hail
*Assistant Examiner* — Jason Khalil Hawkins
(74) *Attorney, Agent, or Firm* — Muncy, Geissler, Olds & Lowe, P.C.

(57) ABSTRACT

A ratchet wrench includes a wrench main body provided at an end thereof with a through hole, wherein a ratchet wheel is disposed, which is provided from top to bottom thereof in order with an upper ratchet portion, an upper annular groove, a middle ratchet portion, a lower annular groove and a lower ratchet portion. The upper and lower ratchet portions both protrude out of the through hole. The middle ratchet portion is located in the through hole. Two retainers are respectively disposed in the upper and lower annular grooves located out of the through hole, for retaining the ratchet wheel in the through hole. As a result, in the ratchet wrench of the present invention, the wrench main body doesn't need much processing, thereby improved in processing convenience. Besides, the installation of the members is convenient and firm, thereby benefiting the operation of the ratchet wheel.

3 Claims, 6 Drawing Sheets

(56) References Cited

U.S. PATENT DOCUMENTS

| | | | | |
|---|---|---|---|---|
| 2007/0113711 | A1* | 5/2007 | Tuan Mu | B25B 23/0035 81/58.1 |
| 2008/0034926 | A1* | 2/2008 | Chaconas | B25B 13/463 81/58.4 |
| 2009/0007731 | A1* | 1/2009 | Chen | B25B 13/463 81/62 |
| 2012/0180603 | A1* | 7/2012 | Hu | B25B 13/463 81/62 |
| 2014/0020519 | A1* | 1/2014 | Chang | B25B 13/463 81/60 |
| 2014/0157959 | A1* | 6/2014 | Yang | B25B 13/463 81/63 |
| 2015/0196994 | A1* | 7/2015 | Huang | B25B 13/04 81/60 |
| 2017/0144276 | A1* | 5/2017 | Yang | B25B 13/04 |
| 2018/0250796 | A1* | 9/2018 | Yang | B25B 13/463 |

* cited by examiner

EASILY ASSEMBLED RATCHET WRENCH

BACKGROUND OF THE INVENTION

1. Field of the Invention

The present invention relates to ratchet wrenches and more particularly, to an easily assembled ratchet wrench.

2. Description of the Related Art

In the structure of a conventional ratchet wrench, as shown in FIG. 1, a wrench main body 1 is provided at an end thereof with an accommodating trough 3 for the installation of a ratchet wheel 2. The wrench main body 1 is processed at the top end of the accommodating trough 3 with an annular track 5 for the installation of a retaining ring 4 and an annular groove 7 for the installation of a covering ring 6. The ratchet wheel 2 is retained in the accommodating trough 3 by the retaining ring 4 and the covering ring 6. Besides, the wrench main body 1 is processed at the bottom end of the accommodating trough 3 with a radial protrusion 8. The ratchet wheel 2 is stopped by the radial protrusion 8, thereby prevented from falling out of the accommodating trough 3.

However, providing the wrench main body 1 with the features such as the annular track 5, the annular groove 7 and the radial protrusion 8 needs a time-consuming and complicated processing, and the processing inaccuracy is liable to affect the following assembly accuracy, thereby resulting in unsmooth operation of the ratchet wheel 2.

SUMMARY OF THE INVENTION

It is a primary objective of the present invention to provide a ratchet wrench which is easy in assembly and improved in processing convenience.

To attain the above objective, the ratchet wrench of the present invention includes a wrench main body, a ratchet wheel, a ratchet block and two retainers. The wrench main body is provided at an end thereof with a through hole penetrating through top and bottom surfaces of the wrench main body and an accommodating room radially communicating with the through hole. The ratchet wheel is rotatably disposed in the through hole of the wrench main body. The ratchet wheel has an upper ratchet portion, a middle ratchet portion, a lower ratchet portion, an upper annular groove and a lower annular groove. The upper ratchet portion and the lower ratchet portion both protrude out of the through hole. The middle ratchet portion is located in the through hole. The upper annular groove is located out of the through hole and located between the upper ratchet portion and the middle ratchet portion. The lower annular groove is located out of the through hole and located between the middle ratchet portion and the lower ratchet portion. The ratchet block is disposed in the accommodating room of the wrench main body and elastically engaged with the middle ratchet portion of the ratchet wheel for limiting the rotational direction of the ratchet wheel. One of the two retainers is disposed in the upper annular groove of the ratchet wheel, and the other of the two retainers is disposed in the lower annular groove of the ratchet wheel, so that the ratchet wheel is retained in the through hole by the two retainers.

It can be known from the above description that in the ratchet wrench of the present invention, the ratchet wheel is processed with the upper annular groove and the lower annular groove for cooperating with the two retainers to provide the positioning effect, so the wrench main body doesn't need much processing, thereby improved in processing convenience. Besides, the installation of the members is relatively more convenient and firmer, thereby benefiting the operation of the ratchet wheel.

Preferably, the axial height of the middle ratchet portion of the ratchet wheel is larger than the axial height of the upper ratchet portion of the ratchet wheel and larger than the axial height of the lower ratchet portion of the ratchet wheel. Besides, the axial height of the upper ratchet portion of the ratchet wheel is equal to the axial height of the lower ratchet portion of the ratchet wheel.

Preferably, each of the retainers is C-shaped and has rectangular or circular cross sections.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
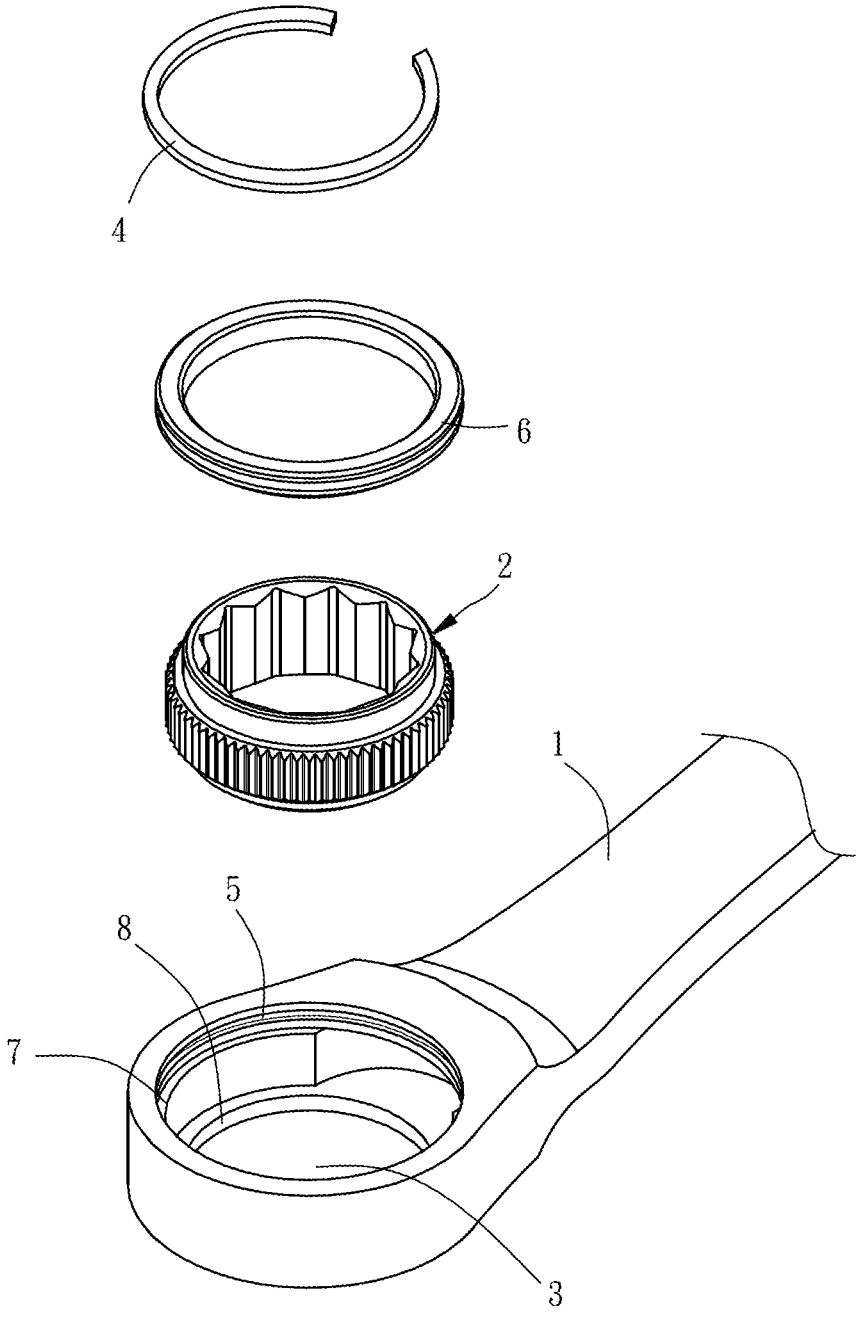
FIG. 1 PRIOR ART
FIG. 1 is an exploded perspective view of a conventional ratchet wrench.

First of all, it is to be mentioned that throughout the specification, including the following embodiments and the claims, the directionality-related nouns are all based on the direction in the figures. Besides, same reference numerals used in the following embodiments and the figures designate same or similar elements or the structural features thereof.

Figure 2:
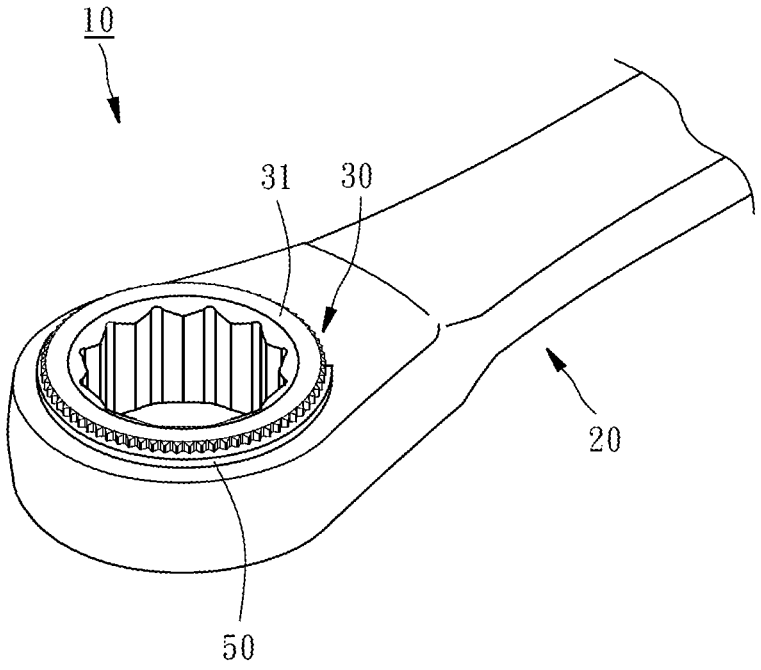
FIG. 2 is a perspective view of a ratchet wrench of a first embodiment of the present invention.
Figure 3:
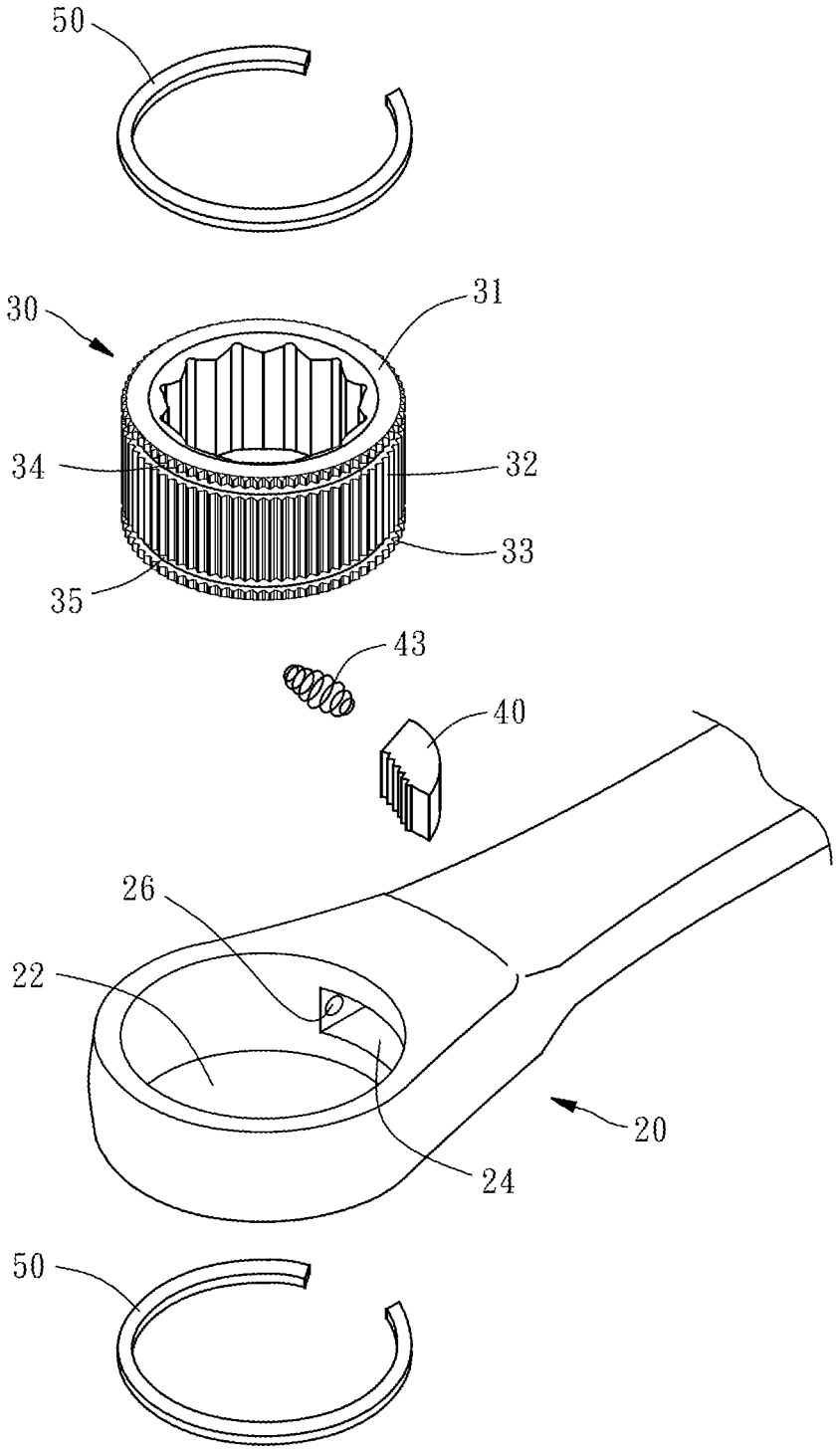
FIG. 3 is an exploded perspective view of the ratchet wrench of the first embodiment of the present invention.

Referring to FIGS. 2 and 3, a ratchet wrench 10 of the present invention includes a wrench main body 20, a ratchet wheel 30, a ratchet block 40, and two retainers 50.

The wrench main body 20 is provided at an end thereof with a through hole 22 penetrating through top and bottom surfaces of the wrench main body and an accommodating room 24 radially communicating with the through hole 22.

Figure 4:
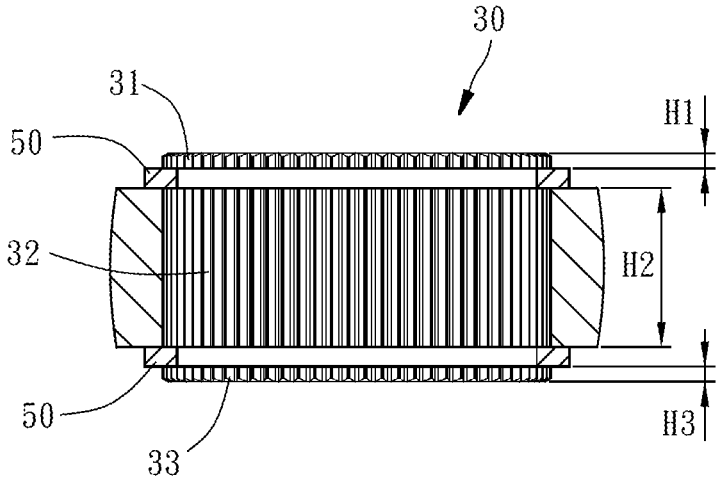
FIG. 4 is partially sectional view of the ratchet wrench of the first embodiment of the present invention.

The ratchet wheel 30 is provided from top to bottom thereof in order with an upper ratchet portion 31, a middle ratchet portion 32 and a lower ratchet portion 33. As shown in FIGS. 3 and 4, the axial height H1 of the upper ratchet portion 31 is equal to the axial height H3 of the lower ratchet portion 33. The axial height H2 of the middle ratchet portion 32 is larger than the axial height H1 of the upper ratchet portion 31 and the axial height H3 of the lower ratchet portion 33. Besides, the ratchet wheel 30 further has an upper annular groove 34 and a lower annular groove 35. The upper annular groove 34 is located between the upper ratchet portion 31 and the middle ratchet portion 32. The lower annular groove 35 is located between the middle ratchet portion 32 and the lower ratchet portion 33. As shown in FIGS. 3 and 4, when the ratchet wheel 30 is installed in the wrench main body 20, the upper and lower ratchet portions 31 and 33 of the ratchet wheel 30 both protrude out of the through hole 22, the middle ratchet portion 32 of the ratchet wheel 30 is located in the through hole 22, and the upper and lower annular grooves 34 and 35 of the ratchet wheel 30 are both located out of the through hole 22.

Figure 5:
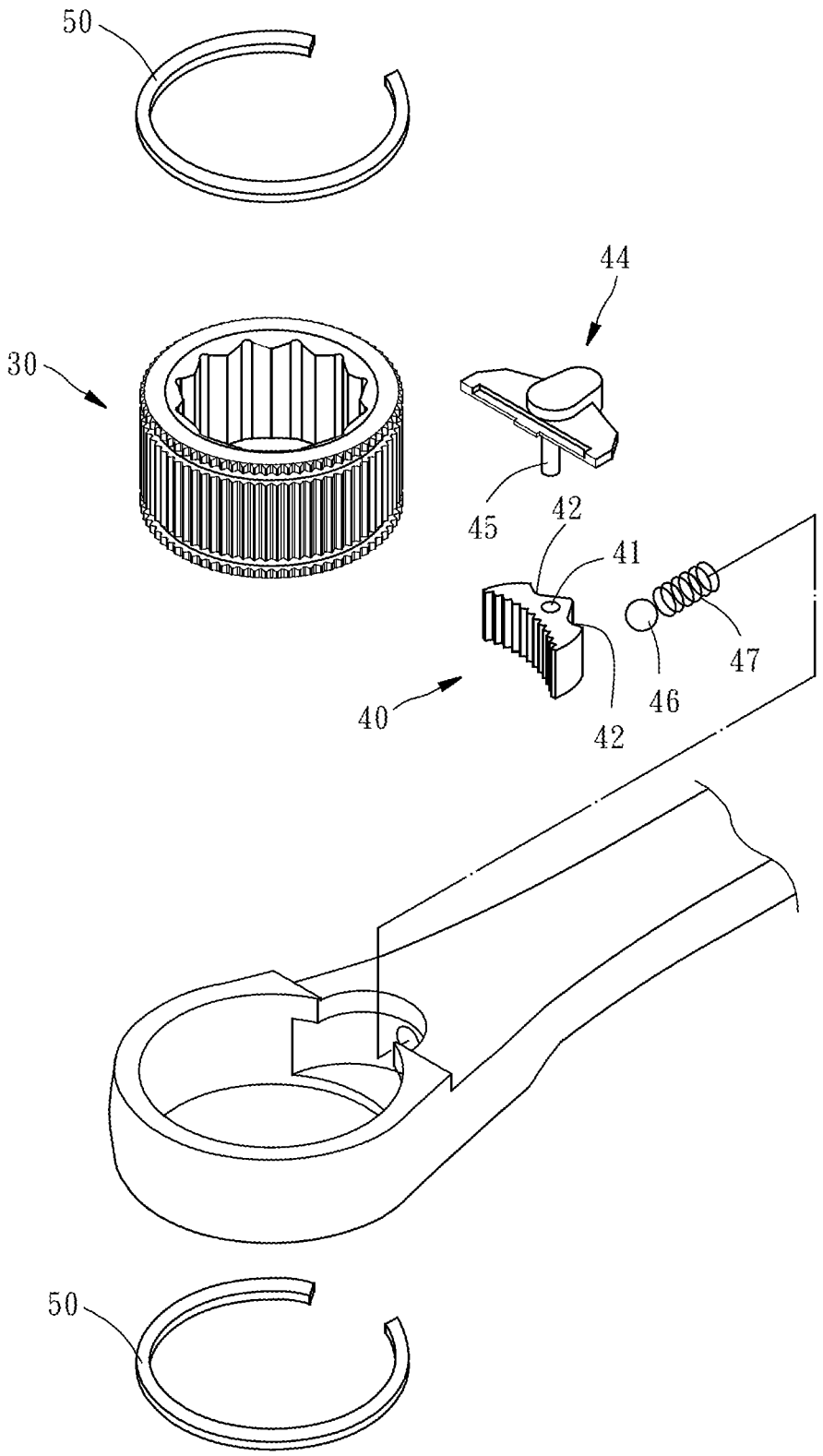
FIG. 5 is an exploded perspective view of a ratchet wrench of a second embodiment of the present invention.

The ratchet block 40 is disposed in the accommodating room 24 of the wrench main body 20 and elastically engaged with the middle ratchet portion 32 of the ratchet wheel 30 for limiting the rotational direction of the ratchet wheel 30. It should be additionally specified here that the ratchet block 40 may cooperate with different members to allow the ratchet wheel 30 one-directional rotation or two-directional rotation. The ratchet block 40 as shown in FIG. 3 is used in company with a spring 43 disposed in a side hole 26 communicating with the accommodating room 24, and an end of the spring 43 is abutted against the ratchet block 40, so that the ratchet block 40 allows the ratchet wheel 30 to rotate in only one direction. As shown in FIG. 5, the ratchet block 40 may be used in company with a push block 44, a ball 46 and a spring 47. The ratchet block 40 is provided on the top surface thereof with an inserting hole 41 for a rod 45 of the push block 44 to be inserted therein, so that the ratchet block 40 can be moved by the push block 44 to deflect relative to the ratchet wheel 30. Besides, the ratchet block 40 is provided on the rear surface thereof with two recesses 42, and the spring 47 applies a force to abut the ball 46 against one of the recesses 42 for positioning the ratchet block 40, so that the ratchet block 40 allows the ratchet wheel 30 two-directional rotation. The way the ratchet block 40 cooperates with the aforementioned members belongs to the prior art and not the key point of the present invention, so the detailed structure and operational theory thereof are not repeatedly mentioned here for saving the space.

Figure 6:
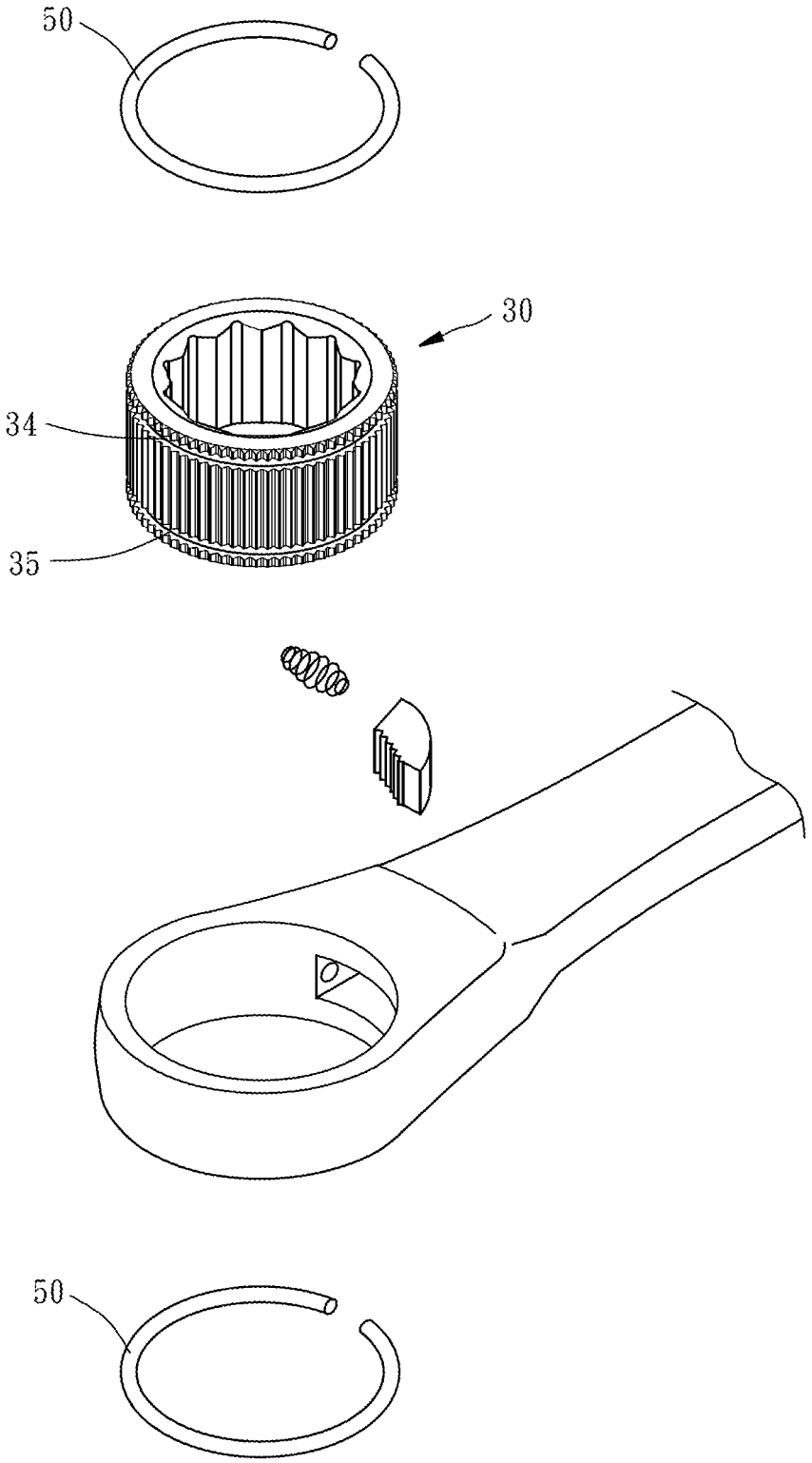
FIG. 6 is an exploded perspective view of a ratchet wrench of a third embodiment of the present invention.

Each of the retainers 50 is C-shaped and the cross sections thereof may be rectangular-shaped (as shown in FIG. 3) or circular-shaped (as shown in FIG. 6). One of the retainers 50 is disposed in the upper annular groove 34 of the ratchet wheel 30, and the other retainer 50 is disposed in the lower annular groove 35 of the ratchet wheel 30, so that the ratchet wheel 30 is retained in the through hole 22 of the wrench main body 20.

It can be known from the above description that in the ratchet wrench 10 of the present invention, the ratchet wheel 30 is processed with the upper annular groove 34 and the lower annular groove 35 for cooperating with the two retainers 50 to retain the ratchet wheel 30 in the through hole 22, so the wrench main body 20 doesn't need much processing, thereby improved in processing convenience. Besides, the installation of the members is relatively more convenient and firmer, thereby benefiting the operation of the ratchet wheel 30.

What is claimed is:

1. A ratchet wrench comprising:

a wrench main body which is provided at an end thereof with a through hole penetrating through top and bottom surfaces of the wrench main body and an accommodating room radially communicating with the through hole;

a ratchet wheel rotatably disposed in the through hole of the wrench main body and having an upper ratchet portion, a middle ratchet portion, a lower ratchet portion, an upper annular groove and a lower annular groove, the upper ratchet portion and the lower ratchet portion both protruding out of the through hole, the middle ratchet portion being located in the through hole, the upper annular groove being located out of the through hole and located between the upper ratchet portion and the middle ratchet portion, the lower annular groove being located out of the through hole and located between the middle ratchet portion and the lower ratchet portion; the upper ratchet portion, the middle ratchet portion and the lower ratchet portion all having a plurality of ratchet teeth, an upper ratchet teeth surface being jointly defined by tips of the ratchet teeth of the upper ratchet portion, a middle ratchet teeth surface being jointly defined by tips of the ratchet teeth of the middle ratchet portion, a lower ratchet teeth surface being jointly defined by tips of the ratchet teeth of the lower ratchet portion, the upper annular groove having an upper annular surface, the lower annular groove having a lower annular surface, the ratchet wheel being provided with an outer circumferential surface which is only constituted by the upper ratchet teeth surface, the upper annular surface, the middle ratchet teeth surface, the lower annular surface, and the lower ratchet teeth surface in sequence, the upper ratchet teeth surface, the middle ratchet teeth surface, and the lower ratchet teeth surface all having an outer radius in equal, the outer radii of the upper ratchet teeth surface, the middle ratchet teeth surface, and the lower ratchet teeth surface all being larger than an outer radius of the upper annular surface and an outer radius of the lower annular surface; a ratchet block disposed in the accommodating room of the wrench main body and elastically engaged with the middle ratchet portion of the ratchet wheel; and two retainers, one of the retainers being disposed in the upper annular groove of the ratchet wheel, the other retainer being disposed in the lower annular groove of the ratchet wheel.

2. The ratchet wrench as claimed in claim 1, wherein the through hole has an inner wall, and the inner wall has a smooth surface.

3. The ratchet wrench as claimed in claim 1, wherein the upper ratchet portion of the ratchet wheel has a top surface higher than the top surface of the wrench main body, and the lower ratchet portion of the ratchet wheel has a lower surface lower than the bottom surface of the wrench main body.

* * * * *